United States Patent [19]

Nisenbaum

[11] Patent Number: 4,828,427

[45] Date of Patent: May 9, 1989

[54] CEMENT SCREED TOOL

[76] Inventor: Phillip Nisenbaum, 7106 Checkerbloom, Citrus Heights, Calif. 95610

[21] Appl. No.: 824,735

[22] Filed: Jan. 31, 1986

[51] Int. Cl.[4] ..... E01C 19/22

[52] U.S. Cl. ..... 404/97; 404/118; 15/144 R; 15/235.4; 425/458; 16/110 R

[58] Field of Search ..... 404/101, 107, 114, 118, 404/119, 97, 120; 15/144 R, 235.4, 235.5; 425/458; 16/110 R, 111 R, 112; 7/105, 167, 168

[56] References Cited

U.S. PATENT DOCUMENTS

| | | | |
|---|---|---|---|
| 2,584,459 | 2/1952 | Jackson | 404/114 |
| 2,599,330 | 6/1952 | Jackson | 404/114 |
| 2,813,466 | 11/1957 | Torgerson | 404/97 X |
| 2,897,735 | 8/1959 | Alessio | 404/118 |
| 2,912,851 | 11/1959 | Karnes | 15/235.5 |
| 3,341,235 | 9/1967 | Mattson et al. | 16/110 R X |
| 4,256,416 | 3/1981 | Bishop | 404/119 |
| 4,386,901 | 6/1983 | Morrison | 404/118 X |
| 4,449,845 | 5/1984 | Carillo | 404/118 |
| 4,495,669 | 1/1985 | Hooper | 16/110 R X |
| 4,752,156 | 6/1988 | Owens | 404/120 X |

FOREIGN PATENT DOCUMENTS

| | | | |
|---|---|---|---|
| 357944 | 10/1931 | United Kingdom | 404/118 |

*Primary Examiner*—Jerome W. Massie
*Assistant Examiner*—John F. Letchford
*Attorney, Agent, or Firm*—Jerry T. Kearns

[57] ABSTRACT

A cement screed tool includes bracket clamps designed to be attached at each end of a long two-man screed, with pivotable handles being attached to each of the clamps. Operators can grip each combined handle and bracket assembly with both hands while standing sideways to the screed, inasmuch as the pivotable handle arrangement includes a pair of spaced-apart hand grips. One of the hand grips is positioned above and the other hand grip is positioned rearwardly of the screed, with selective pivoting of the handles then being permitted by the operators. The specific positioning of the hand grips relative to the screed board facilitates an accurate and efficient control of the screed by an operator.

7 Claims, 3 Drawing Sheets

CEMENT SCREED TOOL

BACKGROUND OF THE INVENTION

1. Field of the Invention

The present invention relates to concrete screed board apparatuses, and more particularly to screed board apparatuses which include board retaining brackets having pivotable handles attached thereto.

2. Description of the Prior Art

As is known by those with ordinary skill in the art, a screed board is used in cement finishing work for leveling freshly poured concrete. If the area of the concrete to be smoothed is relatively narrow, a screed board, which is usually a relatively long, straight board, may be operated by two individuals who place the board on concrete forms and then move it back and forth along the forms to level concrete after it has been freshly poured.

More specifically, as concrete is being poured, substantial care must be taken to level the concrete so that there are no high spots or low areas. When utilizing a screed timber to accomplish this result, a board which is 10 to 16 feet in length is usually used, with the timber being handled by men stooping over with their arms extended downwardly to grasp and move the screed. As can be appreciated, this is a very tiring position, and many cement workers experience back problems in later life. Also, some cement moving to fill voids has to be done by hand, and men have to alternate on this job as it is both physically damaging and tiring. In any event, there has been a recognition of the fact that the use of handles in combination with a screed board apparatus will lessen the physical requirements attendant upon the operators.

A typical use of a handle in combination with a screed is to be found in U.S. Pat. No. 2,897,735 which issued to Alessio on Aug. 4, 1959. In this patent, there is disclosed a screed which includes a pair of upstanding handles rigidly attached to the screed with such handles being operably usable by a single individual. However, as can be appreciated from reviewing the Alessio disclosure, the construction of this handle assembly is such as to permit its use only on small jobs, i.e., with very short length screed timbers inasmuch as its use is designed for only a single operator.

Similiarly, U.S. Pat. No. 4,449,845, which issued to Carrillo on May 22, 1984, discloses a screed board apparatus that includes an upstanding handle assembly to facilitate a use of the screed by a single individual. Again, while a handle assembly which is operably effective for getting an operator off of his knees while finishing concrete is disclosed, neither the handle assembly illustrated in this patent, or the handle assembly priorly discussed, is useful in combination with two-man screeds due to their particular designs. Further, the fixed positioning of the handles in both of these above-discussed patents limits the maneuverability of the single operator, while also limiting his flexibility. Accordingly, the use of these types of handle assemblies will still result in the rapid physical tiring and abuse of an operator.

As such, it can be appreciated that there exists a continuing need for improvements in handle assemblies utilizable with screed boards, and in this respect, the present invention substantially fulfills this need.

SUMMARY OF THE INVENTION

In view of the foregoing disadvantages inherent in the known types of screed board handle assemblies now pesent in the prior art, the present invention provides an improved handle assembly for use with a screed board apparatus wherein the same can be used by operators for a substantially greater period of time without their becoming physically exhausted. As such, the general purpose of the present invention, which will be described subsequently in greater detail, is to provide a new and improved cement screed tool assembly which has all of the advantages of the prior art cement screed tool assemblies and none of the disadvantages. To attain this, the present invention comprises a bracket mountable to a screed board, with such bracket having an upstanding tubular member positionable within a conduit fixably secured to a separable handle assembly. The tubular portion of the bracket, once inserted into the conduit, is secured therein in a manner which allows it to pivot, thereby to facilitate a pivotable movement of the screed board attached to the bracket relative to the handle assembly. The handle assembly includes a pair of hand grips, one of which is positionable directly over the screed board, with the second hand grip being positioned rearwardly thereof. In those cases where a two-man screed board is utilized, a pair of these bracket and handle assemblies may be utilized to facilitate the operation of the board by both operators. Due to the pivotable construction of each of the handle arrangements, an operator is permitted to use his arm, legs, chest, shoulder and waist muscles with good leverage while suffering very little fatigue and few, if any, back injuries.

There has thus been outlined, rather broadly, the more important features of the present invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions so far as they do not depart from the spirit and scope of the present invention.

It is therefore an object of the present invention to provide a new and improved cement screed tool assembly which has all of the advantages of the prior art cement screed tool assemblies and none of the disadvantages.

It is another object of the present invention to provide a new and improved cement screed tool assembly which may be easily and efficiently manufactured and marketed.

It is a further object of the present invention to provide a new and improved cement screed tool assembly which is of a durable and reliable construction, and which is substantially stable and manueverable when being utilized.

Still another object of the present invention is to provide a new and improved cement screed tool assembly which results in fewer physical injuries and less physical tiring by users thereof.

Yet another object of the present invention is to provide a new and improved cement screed tool assembly which is characterized by a lightweight and stable construction, thereby to facilitate the installation, use and transporting thereof.

An even further object of the present invention is to provide a new and improved cement screed tool assembly which is susceptible of a low cost of manufacture with regard to both materials and labor, and which accordingly is then susceptible of low prices of sale to the consuming public, thereby making such cement screed tool assemblies economically available to the buying public.

Still yet another object of the present invention is to provide a new and improved cement screed tool assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
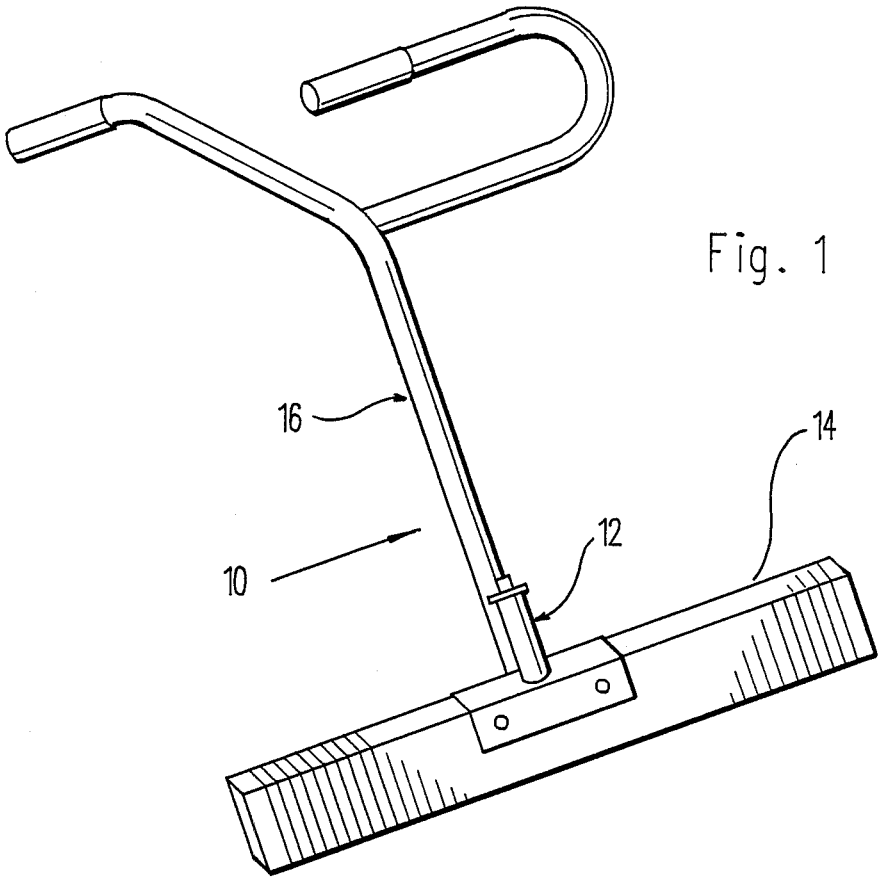
FIG. 1 is a perspective view of a first embodiment of a cement screed tool assembly comprising the present invention.
Figure 6:
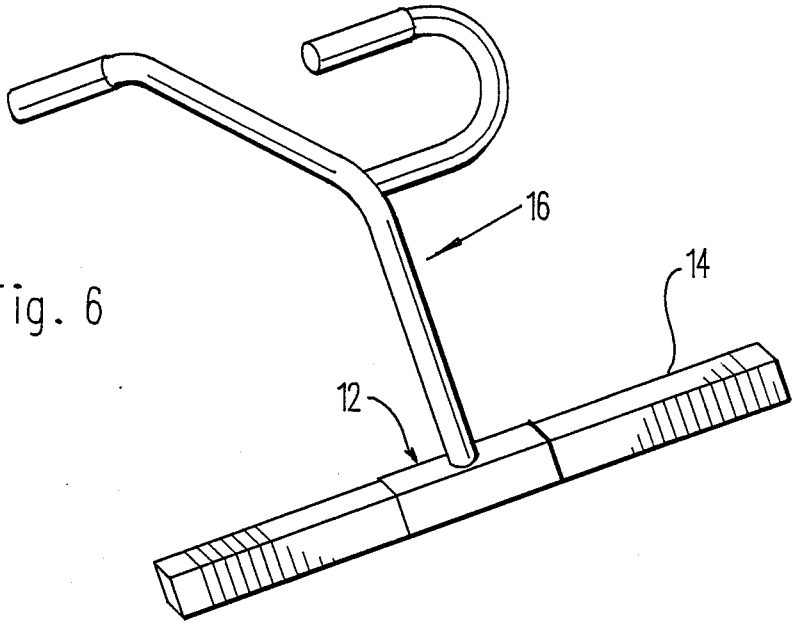
FIG. 6 is a perspective view of a second embodiment of the invention.
Figure 2:
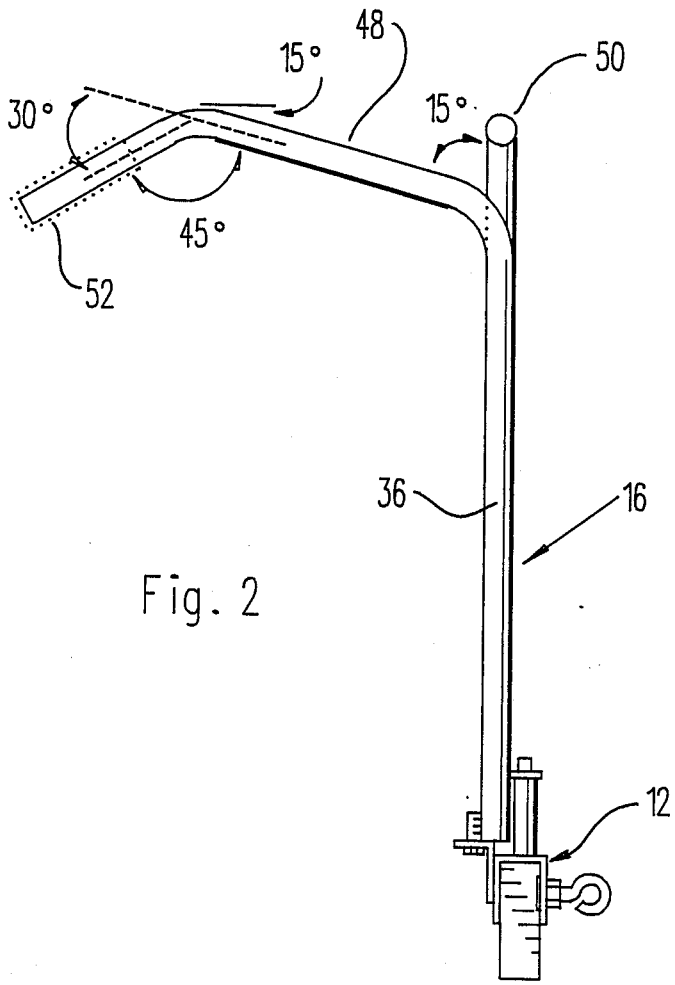
FIG. 2 is a side elevation view thereof.
Figure 5:
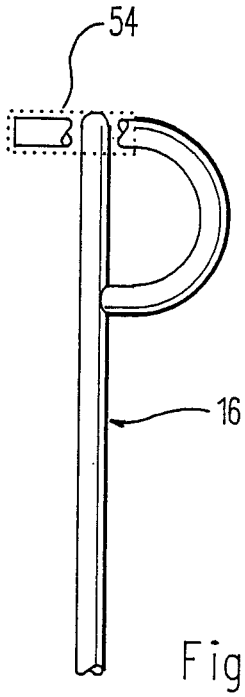
FIG. 5 is a detail view of a front elevation portion of the handle forming a part of the present invention.

With reference now to the drawings, and in particular to FIGS. 1 and 2 thereof, a new and improved cement screed tool assembly embodying the principles and concepts of the present invention and generally designated by the reference numeral 10 will be described.

More specifically, it will be noted that the cement screed tool assembly 10 includes a bracket assembly 12 which facilitates an attachment of the tool assembly to a screed board 14, and further includes a handle assembly 16 which is pivotally attachable to the bracket assembly. While the cement tool assembly 10 shown in FIG. 1 is illustrated as being attached to a single screed board 14, it is to be understood that under normal use conditions, the screed board wo uld be of such a length as to require its manipulation and use by two men, whereby a pair of the cement tool assemblies comprising the present invention would be utilized. In this regard, one cement screed tool assembly 10 would be attached to a first end of the two-man screed board 14, with the second tool assembly then being secured to the opposite end, thereby to facilitate the use of one tool assembly by each of the two operators.

Figure 3:
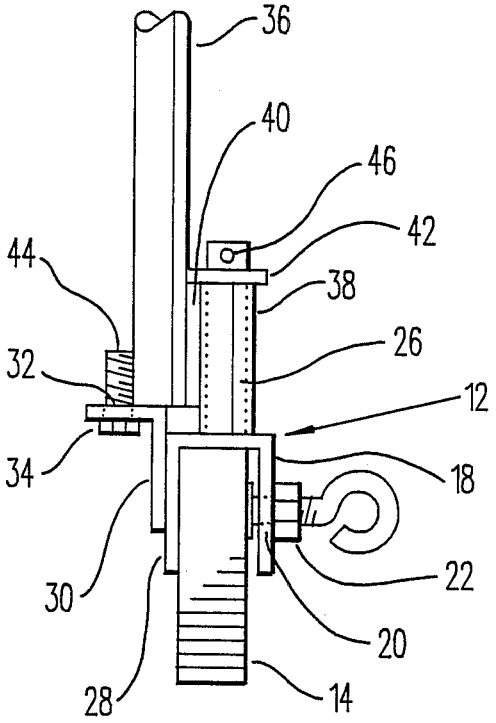
FIG. 3 is an enlarged detail view of a part of the invention.

As to the particular construction of the bracket assembly 12, reference should be had to FIG. 3 of the drawings, which essentially comprises an enlarged view of the same bracket assembly illustrated in FIGS. 1 and 2. As shown in FIG. 3, the bracket assembly 12 includes a channel-shaped bracket member 18 which is designed to be positioned over the screed board 14 in the manner illustrated. The bracket 18 may include a plurality of through-extending apertures 20 through which some conventional fastening means may be positioned. In the preferred embodiment of the invention illustrated in FIGS. 1 and 3, two apertures 20 are employed, with internally threaded nuts 22 fixedly attached to an exterior surface of the bracket member 18 by some conventional means, such as welding or the like, and having the internal threaded opening of the nuts aligned with the apertures 20. As such, conventional eyebolts 24 may be threadably positioned through the nuts 22 to effect a frictional engagement of the screed board 14 within the interior channel porton of the bracket member 18, thereby to operably comprise the manner of retaining a screed board in fixed engagement with the bracket member. Of course, a threaded removal or backing off of an eyebolt 24 will result in a release of the screed board 14 in a now apparent manner.

The bracket assembly 12 further includes an upstanding solid metallic cylindrically-shaped member 26, with such cylindrical member being fixedly attached to the channel-shaped bracket member by some conventional attachment means, such as the aforementioned welding. The cylindrically shaped member 26 operates as a bearing surface to facilitate a pivoting of the handle assembly 16 in a manner to be subsequently described.

Fixedly secured to a rearward surface 28 of the bracket member 18 is an L-shaped locking plate 30, with such plate being fixedly secured to the bracket member by welding or by some other conventional means. The locking plate 30 includes a through-extending aperture 32 designed to facilitate the positioning therethrough of a locking bolt 34, or some other type of fastening means, in a manner which will also be subsequently described.

With continuing reference to FIG. 3 of the drawings, the bottommost positioned structure of the handle assembly 16 will be described, wherein this bottommost structure is designed to operably cooperate and function with the above-described bracket assembly 12. More specifically, the handle assembly 16 includes a downwardly extending tubular support member 36, which most likely would be of a metallic construction, with such support member having a hollow metallic conduit 38 attached to a bottom end thereof. The conduit 38 extends below the bottommost end of the support member 36 and is fixedly secured thereto in parallel alignment therewith by some conventional attaching means. In the preferred embodiment of the invention, the conduit 38 is attached to the bottom end of the handle 36 by an intermediate plate 40 which would most likely be welded between the support member and the conduit. The plate 40 serves as both an attachment means and a strength providing means while, if desired, a washer 42, or some similiar circular plate member having an aperture extending therethrough, may be positioned on a topmost portion of the conduit 38 in a plane which is orthogonally aligned with the axis of the conduit. The washer 42 must have an aperture of sufficient diameter to permit an extension therethrough of the above-discussed cylindrically shaped bearing member 26.

Also shown in FIG. 3 is a further tubular member 44 fixedly secured to a bottommost portion of the support member 36 by welding or the like, with this further tubular member also being internally threaded for receiving the aforementioned locking bolt 34. When assembled, it will be noted that the cylindrically shaped bearing member 26 is inserted upwardly through the conduit 38, with a cotter pin 46, or some similiar locking means such as a locking ring or the like, being positioned through a pre-existing aperture in an end portion of the bearing member, thereby to retain it in position within the conduit 38 while permitting pivotal movement of the bracket member 18 relative to the support member 36. However, a positioning of the locking bolt 34 through the aperture 32 in the L-shaped locking plate 30 and into threaded engagement with the tubular member 44 will result in a fixed positioning of the bracket member 18 relative to the handle 36, i.e., no pivotable movement of the bracket assembly and the screed board 14 attached thereto will be permitted relative to the handle 36.

Figure 4:
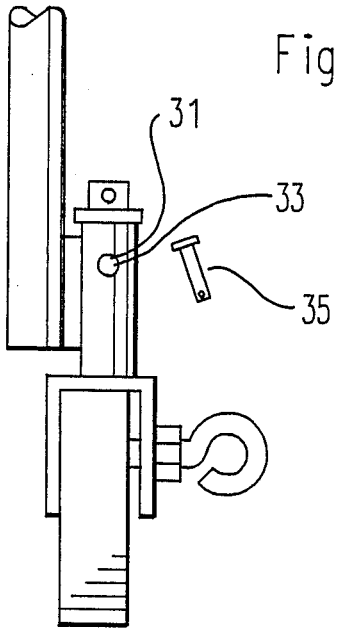
FIG. 4 is an enlarged detail view of a modified locking means for the invention.
Figure 7:
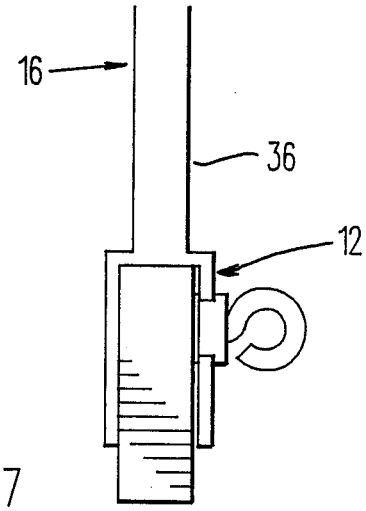
FIG. 7 is an enlarged detail view of a part of the second embodiment of the invention.

FIG. 4 shows a modified embodiment of a locking means which is operable to prevent a pivotal movement of the bracket assembly 12 with respect to the handle assembly 16. More particularly, in lieu of the L-shaped locking plate 30 attachable to the tubular member 44 by means of the locking bolt 34, the cylindrically shaped member 26 may be provided with one or more laterally directed, through-extending apertures 31 which are selectively alignable with a laterally directed, through-extending aperture 33 in the conduit 38. A locking pin 35 may be inserted through the aligned apertures 31, 33, thereby resulting in the fixed positioning of the bracket member 18 relative to the handle 36.

With respect to the specific construction of the handle assembly 16, reference should be had to FIGS. 1, 2 and 4 wherein it will be noted that the handle assembly includes the afore-discussed metallic, tubular support member 46 which extends in a vertical upward direction from the bracket assembly 12 and further includes a pair of laterally extending handles 48, 50. As shown, the handles 48, 50 are either integral with or fixedly secured to the support member 36 with the handle 48 extending rearwardly of the bracket assembly 12 and the handle 50 being substantially paralleledly aligned with the screed board 14 positioned within the bracket assembly. The handle 48 includes a handle grip 52 and is designed to always be rearwardly positioned relative to the axis of the screed board 14, while the handle 50, which includes a hand grip 54, will normally always be retained in substantially parallel alignment with the board. This handle arrangement has been shown to be particularly effective in preventing user fatigue, while providing optimum flexibility and maneuverability to the user during an operable use of the screed board apparatus.

As an alternative to the pivotable embodiment of the invention as illustrated in FIGS. 1-4, FIGS. 6 and 7 illustrate a second embodiment of the invention wherein the handle assembly 16 is fixedly secured to the bracket assembly 12. As most clearly illustrated in FIG. 7, the bottom most section 36 of the handle assembly 16 may be integrally or otherwise fixedly secured to the bracket assembly 12 in a manner whereby no selective pivotable movement between the handle and bracket assemblies is permitted. This construction is useful when only small screed boards 14 are going to be utilized, whereby a single operator can manipulate the entire invention.

With respect to the manner of use and operation of the cement screed tool assembly 10 comprising the present invention, it will be appreciated that a pair of the assemblies can be clamped at each end of a long two-man screed. The operators grip the handle assembly 16 while standing sideways to the screed board 14, with the operators having their forward hands on the handles 50 and their remaining hands on the rear handles 48. The screed board 14 may then be lifted, moved forward and lowered onto the guide edges and concrete, with a subsequent pulling back towards the operator then being accomplished while the concrete is dragged with the screed board. Low spots in the concrete can be filled with user foot motion or with a concrete rake. The versatility of the handle assembly 16 permits the screed board 14 to be moved back and forth, up and down and sideways, while also permitting it to be tilted backward or forward, while the bracket assembly 12 permits a pivoting when needed, to avoid obstacles and the like. Through the use of this assembly 10, an operator is constantly using his arms, legs, chest, shoulder and waist muscles with good leverage while experiencing very little fatigue and physical injury. In effect, much greater control of the screed board 14 is provided.

Where the pivoting motion is desired to be locked in position on the pivotable handle form of the invention, a locking strip may be utilized, such as by installing the strip through apertures 31, 33 although such strip is not illustrated in the drawings, while the locking bolt 34 can also be installed where single operator operation is desired, as in the case of the use of a short screed board 14. Typically, the locking bolt 34 would be used in those situations where a narrow timber 14 is employed, such timber ranging from two feet to five feet in length, while a pair of the tool assemblies 10 would be required for screed boards ranging in length from 6 to 18 feet or greater.

While only a single tube frame has been described and illustrated as forming the handle assembly 16, it is to be realized that variations in frame design can be employeed without departing from the intent or scope of th present invention. In this respect, alternative embodiments of the invention employ various types of stiffener supports directed between the support member 36 and the respective handles 48, 50.

With respect to the above-description, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cement screed tool assembly, comprising:
   a. a bracket means operably attachable to a screed board means; and,
   b. a handle means pivotally attached to said bracket means, said handle means further including a pair of hand grips wherein a first of said hand grips is positioned rearwardly of said screed board means and is aligned substantially orthogonally to a longitudinal axis of said screed board means, and a second of said hand grips is positioned substantially directly above said screed board means and is aligned substantially paralleledly with a longitudinal axis of said screed board means.

2. The cement screed tool assembly of claim 1, wherein an upstanding cylindrical bearing member is fixedly attached to said bracket means, said bearing member being receivable within a tubular bearing receiving member, said tubular bearing receiving member being fixedly attached to said handle means, said bearing member being pivotally retained within said tubular bearing receiving member, thereby facilitating a pivotal movement of said handle means about an axis normal to a longitudinal axis of said screed board means.

3. The cement screed tool assembly of claim 2, and further including a locking means, wherein said locking means includes a locking plate fixedly secured to said bracket means, said locking plate being operably fixedly securable to a locking member fixedly secured to said handle means.

4. The cement screed tool assembly of claim 2, wherein a threaded fastening means is positionable between said locking plate and said locking member.

5. The cement screed tool assembly of claim 2, and further including a locking means wherein said locking means includes a first through-extending aperture directed through said bearing member and a second through-extending aperture directed through said bearing receiving member, said first and second apertures being alignable when said handle means is selectively positioned relative to said screed board means, whereby a pin means may then be inserted through said first and second apertures.

6. A cement screed tool assembly, comprising:
   a. a bracket means operably attachable to a screed board means; and,
   b. a handle means fixedly attached to said bracket means, said handle means further including a pair of hand grips, a first of said hand grips being positioned rearwardly of said screed board means, and aligned substantially orthogonally to a longitudinal axis of said screed board means, and a second of said hand grips being positioned substantially directly above said screed board means and substantially paralleledly aligned with a longitudinal axis of said screed board means.

7. The cement screed tool assembly of either of claims 1, 2, 3, 4, 5, or 6, wherein said handle means are attachable to said screed board means in a manner which permits an operator to utilize said tool assembly while standing upright.

* * * * *